US005305701A

United States Patent [19]

Wilson

[11] Patent Number: 5,305,701

[45] Date of Patent: Apr. 26, 1994

[54] DEVICE FOR CONTROLLING BOAT SPEED

[76] Inventor: John B. Wilson, 1248 Albert Ave., Muskegon, Mich. 49442

[21] Appl. No.: 52,154

[22] Filed: Apr. 23, 1993

Related U.S. Application Data

[63] Continuation-in-part of Ser. No. 850,965, Mar. 12, 1992, abandoned.

[51] Int. Cl.[5] ..... B63H 25/44

[52] U.S. Cl. ..... 114/145 A; 440/66; 440/900

[58] Field of Search ..... 114/145 A, 145 R, 274, 114/280, 284; 440/66, 900, 78, 51

[56] References Cited

U.S. PATENT DOCUMENTS 4,026,231 5/1977 Fedorko ..... 114/145 A 4,232,626 11/1980 Kern ..... 114/285

4,781,632 11/1988 Litjens et al. ..... 114/145 A 5,005,507 4/1991 Dyer ..... 114/145 A

*Primary Examiner*—Edwin L. Swinehart

*Attorney, Agent, or Firm*—Elizabeth H. Schoettly

[57] ABSTRACT

The invention relates to attachments to the anticavitation plate of a boat motor for making and controlling small variations in boat speed below the normal motor idling speed to facilitate trolling for fish. The trolling speed control includes an incrementally adjustable unitary plate mounted for movement between a position fully across the normal paths of the propeller wash, thereby to slow the speed of the boat and to a fully retracted position out of the path of the propeller wash. This invention relates to motorboat low speed control devices.

6 Claims, 3 Drawing Sheets

DEVICE FOR CONTROLLING BOAT SPEED

This is a continuation in part of application Ser. No. 07/850,965, filed Mar. 12, 1992 now abandoned.

BACKGROUND OF THE INVENTION

This invention aids fishermen in safely controlling boat speed below the normal idling speed of the motor without stalling or risking fouling of the engine. Most importantly to the fisherman, the device aids in maintaining uniform boat engine speed. Thus, repetitive stalling and restarting the engine does not disturb the fish, resulting in an improved catch.

This invention is adaptable to a variety of boat motors. The simple attachment to the anti-cavitation plate, or its equivalent, provides ease of operation.

A problem encountered with low motor speed controlling devices is that the desired boat speed is not sustainable without stalling the engine. A variety of other devices have been placed in the market which are clumsy to operate or unduly complex. These other devices required adaptation to the individual motor/-boat configuration rendering the devices unduly complex.

This invention allows the fisherman to use one motor on the fishing boat rather than adding a "trolling motor" to the transom of the boat. Thus, economically, the fisherman is able to troll without two or more motors on a small craft. Additionally, the device can be easily removed and attached for security.

An excellent discussion of the prior art is found in the "Background of the Invention" portion of U.S. Pat. No. 4,026,231 issued May 31, 1977 to Fedorko.

Since the issuance of the Fedorko patent, no substantial improvements have been made over the Fedorko device until the invention hereby proposed. The Fedorko device was primarily devised for an inboard/-outboard motorboat propulsion system, and as such his mounting pivots and plate design were not well adapted to the ordinary outboard motor configuration. Because of his design, his device was unduly complex, particularly in his trolling plate which had its upper portion pivoted above the anti-cavitation plate so that a cutout of some kind, was always necessary in his trolling plate.

In view of these difficulties and problems, it is apparent that improvements are needed in this art and especially in the direction of simpler, easier to control and more durable types of apparatus. This invention solves these problem in a manner that is simple to operate and effective for incrementally controlling the boat speed in a safe manner.

SUMMARY OF THE INVENTION

This invention is a low speed control device adapted to be mounted on the anti-cavitation plate of a boat's propulsion unit which includes a motor and propeller. The device comprises a unitary plate including spaced brace members defining a pivot aperture adjacent to an end portion of the plate, and an actuator pivot aperture spaced from the plate end portion defining the mounting pivot aperture. There are included mounting bracket means adapted to clamp onto the anti-cavitation plate. The bracket means include a top actuator pivot aperture disposed above the anti-cavitation plate, and also includes a lower pivot aperture disposed no lower than the horizontal plane defined by the anti-cavitation plate when the motor is in operative position.

The actuator is longitudinally extensible and retractable. There are connecting means for connecting the actuator to the top actuator pivot aperture of the mounting bracket and a second connection means for connecting the opposite end of the actuator to the unitary plate.

The unitary plate is thereby movable between a vertical position where the plate is deployed immediately aft of the propeller and blocks the wash from the propeller. When not in use, the unitary plate is spaced apart from the propeller and parallel to the plane of the anti-cavitation plate.

There is also provided a source of power to the actuator to cause the actuator to be extended or contracted to incrementally move the unitary plate between its vertical and horizontal positions.

The main object of the invention is to provide an improved low speed control device for attachment to the cavitation plate of motorboats, both outboard and inboard/outboard, which is rugged and durable in usage and which is economical to construct, assemble and maintain.

The object of the invention is accomplished by a pair of brackets which are secured to the motor's anti-cavitation plate, each bracket having a pivot hole in the top and bottom portion, with the bottom pivot hole being at the rear of the cavitation plate and in or below the horizontal plane determined by said plate. Then a unitary plate (without any expensive apertures or offsets needed by Fedorko to clear the cavitation plate) is pivotally connected to a pivot pin extending through the lower pivots on said brackets, and then an electrically operated actuator is connected between a pivot pin extending through the top pivot holes on the brackets.

The actuator is connected to a source of energy in the boat, such as a battery associated with the boat propulsion unit, or a separate battery if desired, whereby with the use of a three position switch the actuator can be extended to move the unitary plate to a fully deployed position (in a propeller wash blocking position) or retracted.

Various other objects and advantages of the invention will be more fully apparent from the following specification, claims and drawings.

DESCRIPTION OF PREFERRED EMBODIMENT

The invention is designed to attach to the anti-cavitation plate of an inboard or outboard motor. Incremental adjustment of the position of the unitary plate controls boat speed and engine speed by placement of the resistive unitary plate relative to the propeller wash. Thus boat speed is regulated and controlled. The power source for incremental movement of the unitary plate is an electric motor which is attached to the battery. Another independent power source may be provided, as appropriate.

This invention allows the boat speed to be simply regulated by the boat operator in increments at least as small as about 0.1 miles per hour without affecting engine throttle speed. No permanent attachment to a boat is required for operation of the device. The device may be configured in a removable and easily attachable manner.

Installation of the device is simple. The device also may be configured to work with a variety of boat motor sizes. Larger motors may require a heavier bracket attachment. In addition, use of fishers bolts and nuts as an alternative to set screws provides but one means for effecting quick release and attachment of the device.

Figure 1:
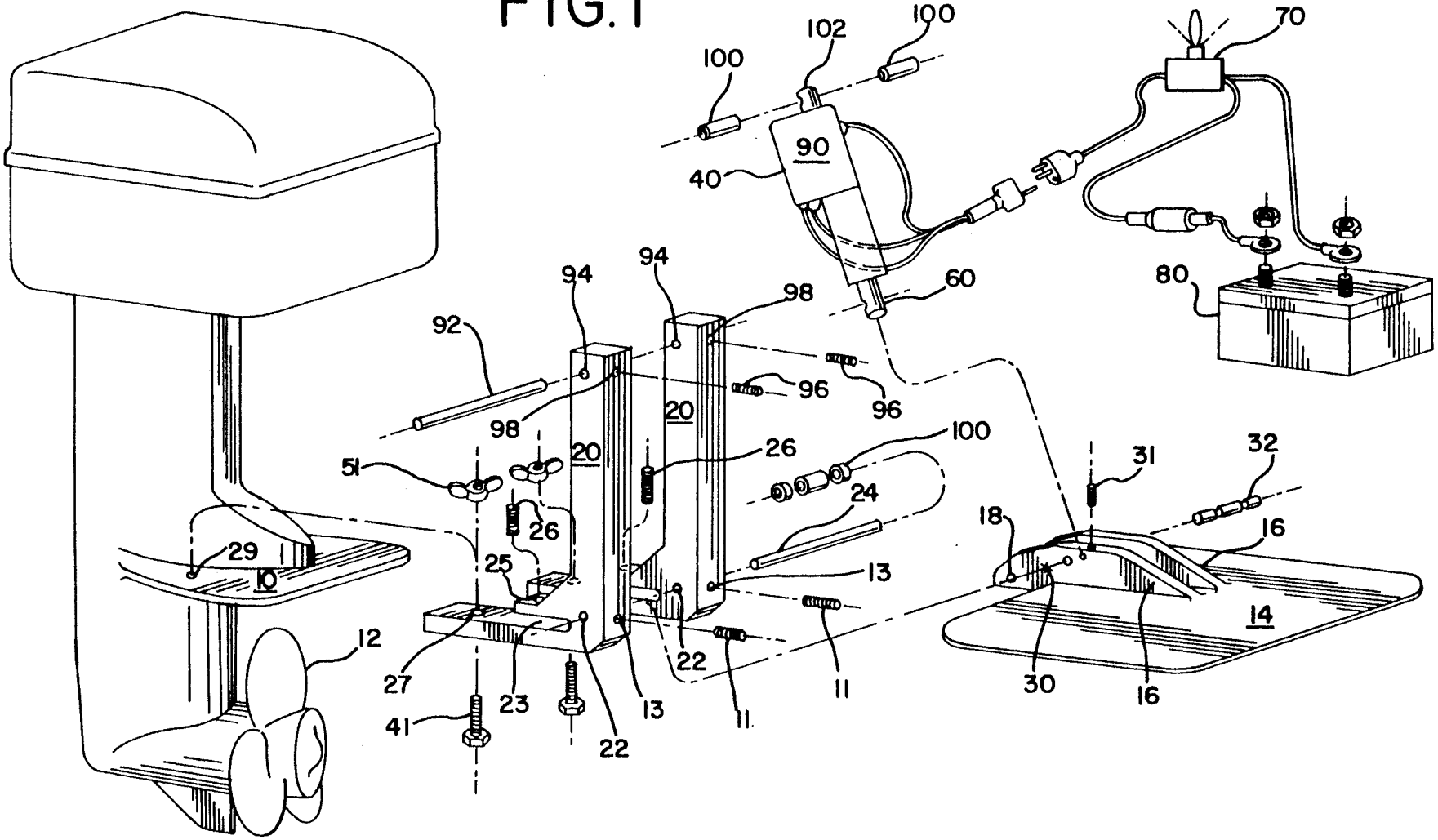
FIG. 1 is an exploded perspective view of all elements of the present invention.
Figure 2:
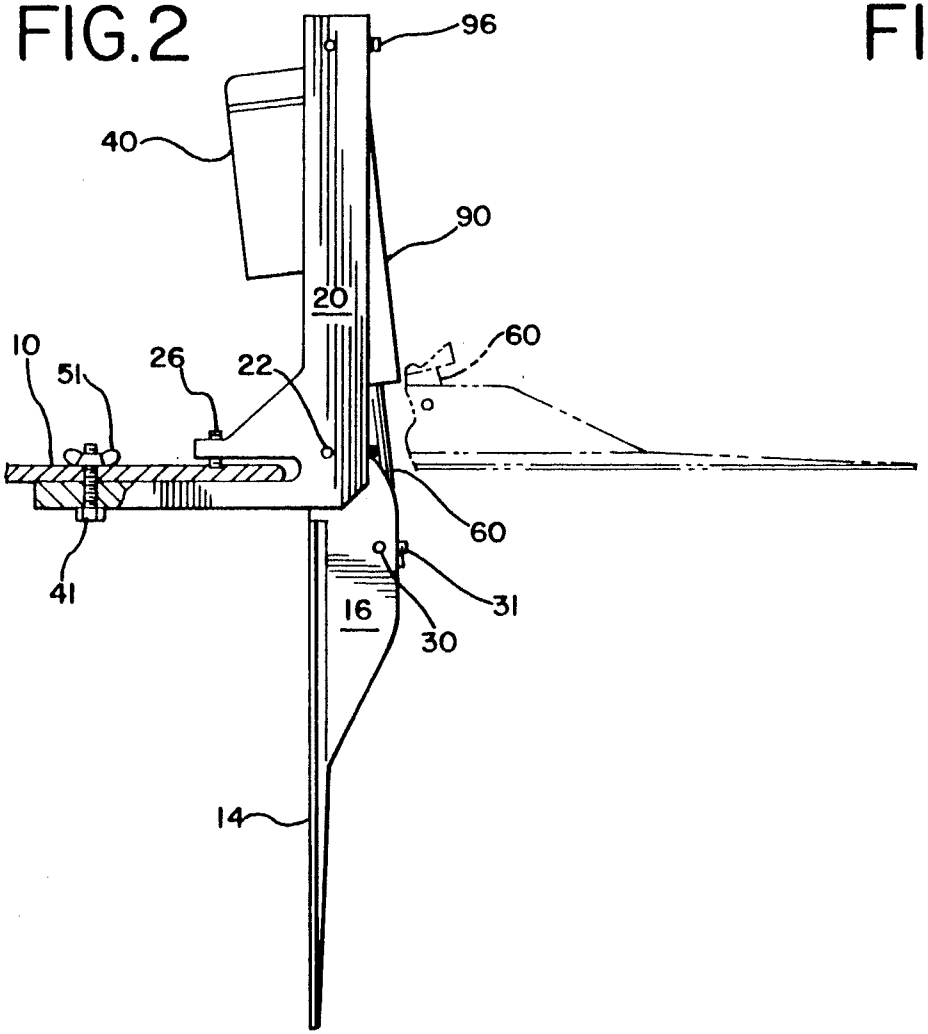
FIG. 2 is a side view of the unitary plate and brackets mounted on the cavitation plate in fully deployed position.

Referring initially to FIGS. 1 and 2, the reference character 10 is the anti-cavitation plate of a motor. Said plate always completely overlies the most rearwardly disposed portion of the boat propeller 12. The motor may be of the inboard, inboard/outboard or outboard type as all types of marine propulsion units include an anti-cavitation plate which overlies the propeller when the motor is disposed in operative position.

The low speed control device of the present invention comprises only three main components which are the brackets 20 adapted to be clamped to the anti-cavitation plate 10, the unitary plate 14, and the actuator 40.

Figure 3:
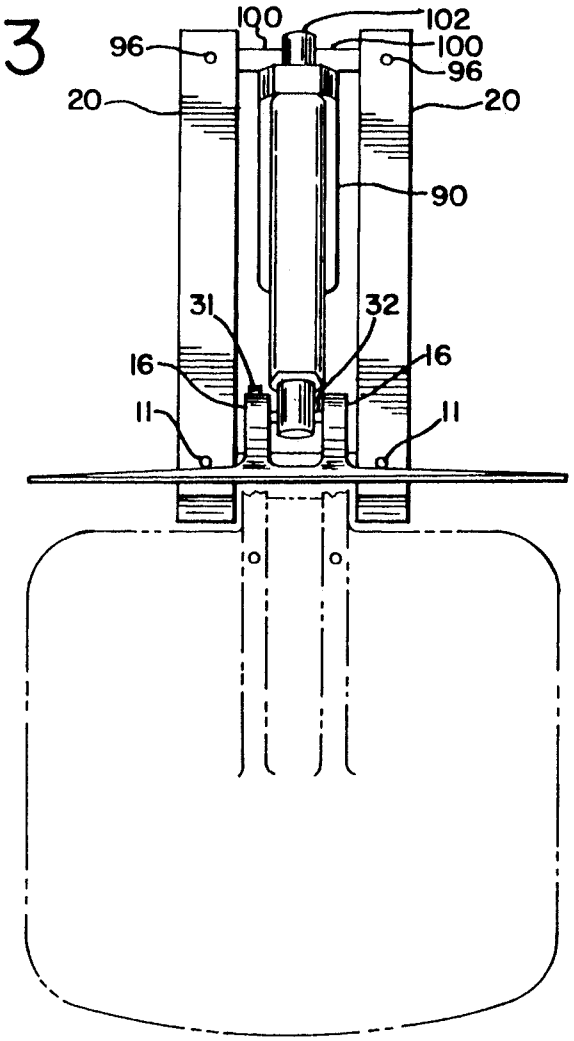
FIG. 3 is a perspective view of a rear view of the unitary plate and brackets mounted on tech cavitation plate in fully retracted position.

The unitary plate has a pair of spaced members 16, each with an aperture 18 therethrough near its top portion. The brackets 20 have apertures 22 at their lower portions and the brackets are secured to plate 10 in spaced relationship (as shown in FIG. 3) s that pivot pin 24 can extend through apertures 18 and 22. This allows the plate to freely pivot thereon, permitting the actuator piston 60 to extend through the space between plate portions 16 for connection to pivot pin 32 which extends through apertures 30 on the plate. Pin 32 is secured in place by a set screw 31 which is received by threaded aperture 33. Pivot pin 24 is secured in place by tightening set screws 11 in threaded apertures 13 of brackets 20.

The device thus permits the positioning of the unitary plate 14 into the wash of the propeller. By blocking the wash, in incremental steps, the motor continues to run without stalling. Control of the boat speed is obtained by controlling the amount of propeller wash blocked by the unitary plate 14.

In the preferred embodiment, pivot pin 32 is scored as a safety feature to act as a quick release of the unitary plate 14 from its engaged position. This feature prevents a sudden increase in motor speed from causing the hull from lifting out of the water. In instances of sudden increase of motor speed, the torque produced by the propeller wash could cause the hull to lift from the water. The breakaway action of pivot pin 32, immediately disengages the device. Thus, boat control is maintained. Also, the device would, in such circumstance, move harmlessly out of the propeller wash.

When the actuator 40 is energized, the unitary plate 14 is movable between the vertical position shown in FIG. 2, where the plate is deployed immediately aft of the propeller and blocks the wash therefrom, to a horizontal position shown in phantom outline in FIG. 2 where the plate is away from the propeller and located wholly above and parallel to the plane of the anti-cavitation plate 10 in a non-operative position. The plate 14 may be set at any angle between the fully engaged vertical position and the non-operative horizontal position through operation of the actuator switch 70.

The bracket shown in FIG. 1 includes a slot 23 and at least one threaded aperture 25 to receive a set screw 26 used to affix the bracket on the anti-cavitation plate 10. Additionally, apertures 27 in brackets 20 are provided to cooperate with apertures 29 which are drilled in plate 10, which receive a fishers bolt 41 and wing nut 51 which are tightened to secure the brackets 20 to the plate 10.

Figure 4:
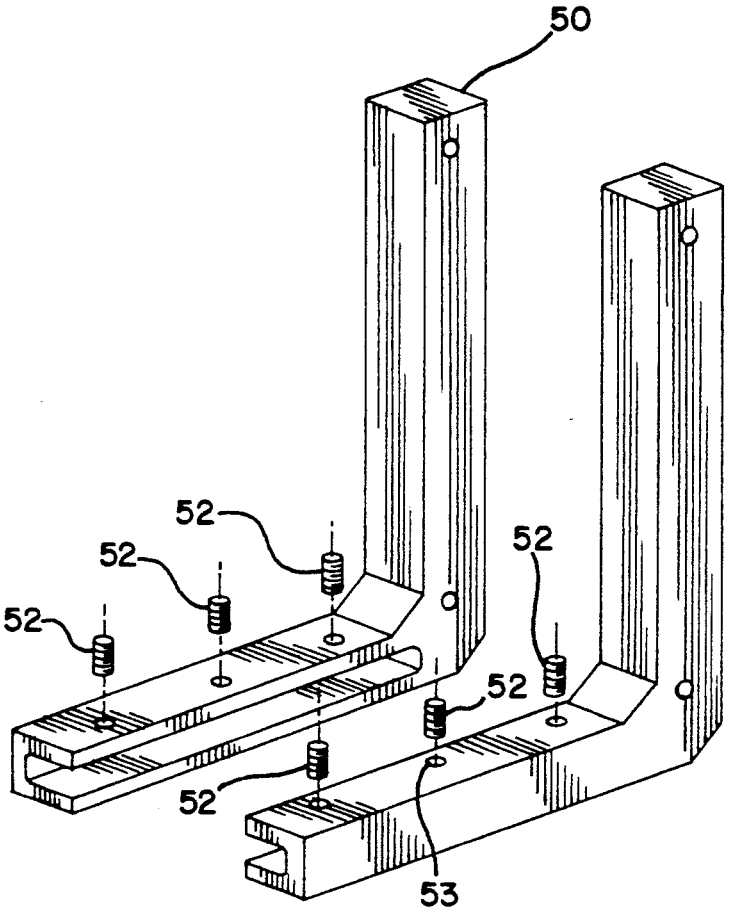
FIG. 4 is an alternative mounting bracket that secures to the cavitation plate by set screws exclusively.

Another embodiment of mounting bracket 50 is shown in FIG. 4, and the slot in this bracket surrounds plate 10 and several set screws 52 are inserted through threaded apertures 53 so that a very rigid clamping action can be obtained. This type of bracket is especially useful for larger size motors where more vibration stresses are usually generated.

The actuator is an electrical mechanical device of the type manufactured by Warner Electric, and is referred to by them as their Model Electra 1. This is the preferred type of electric actuator that may be used to incrementally move the unitary plate between its fully deployed and retracted positions and forms no part of the present invention as to the specific type of actuator shown.

The operation and direction of activation of actuator 40 is controlled by an electric switch generally indicated at 70 in FIG. 1 which may be of the type illustrated wherein the switch control member is movable to any one of three positions being a deployed/null, or retracted, to effect actuation of the actuator piston 60 between either the fully deployed or fully retracted positions shown in FIG. 2 and FIG. 3, or at some selected point therebetween. Actuator 40 has a body portion 90 which is connected to brackets 20 by means of a pin 92 which extends through aperture 94 located in the top portion of brackets 20 and said pin 92 is secured to bracket 20 by set screws 96 which are received in threaded aperture 98, and spacers 100 serve to confine cylinder portion 102 in alignment between spaced brackets 20. The source of energy is in the boat, such as the battery 80.

While a particular embodiment of the invention has been shown and described, it will be understood that the invention is not limited thereto since obvious modifications may be made, and it is therefore contemplated that the appended claims cover any such modifications as fall within the scope of the invention as generally described.

What is claimed is:

1. A low speed control device adapted to be mounted on the anti-cavitation plate of a boat's propulsion unit, which includes a motor and a propeller operatively connected thereto, wherein the anti-cavitation plate defines a horizontal plane when the motor is in operative position, which device comprises, in combination:

a unitary plate including spaced members defining a mounting pivot aperture adjacent an end portion of the plate, and an actuator pivot aperture spaced from the plate end portion defining the mounting pivot aperture;

mounting bracket means adapted to clamp onto said anti-cavitation plate, said bracket means including a top actuator pivot aperture disposed above said anti-cavitation plate, and also including a lower actuation pivot aperture disposed no lower that the horizontal plane defined by said anti-cavitation plate when the motor is in operative position;

an actuator being longitudinally extensible and retractable;

first connection means for connecting one end of said actuator to the top actuator pivot aperture of the mounting bracket means and second connection means for connecting the opposite end of the actuator to the unitary plate whereby all forces of extension or contraction of the actuator are between the top pivot on the mounting bracket means and the actuator pivot on the unitary plate;

the unitary plate being movable between a vertical position where the plate is deployed immediately aft of the propeller and blocks the wash therefrom and a horizontal position where the unitary plate is spaced from the propeller and located parallel to the plane of the anti-cavitation plate; and a source of power to said actuator to cause the same to be extended or contracted to incrementally move the unitary plate between its vertical and horizontal positions.

2. The invention defined by claim 1 wherein the actuator comprises an electrically actuated power cylinder.

3. The invention defined by claim 2 wherein the source of power comprises an electric storage battery.

4. The invention defined by claim 1 wherein said mounting bracket includes a pair of spaced brackets which include, at their respective lower portions, clamping means for engagement with said anti-cavitation plate, said mounting brackets being universally compatible with all anti-cavitation plates on all inboard/outboard and all outboard motors.

5. The invention defined by claim 1 wherein said mounting bracket includes attachment means for removably attaching the mounting brackets to the anti-cavitation plate of an inboard, inboard/outboard and outboard motors.

6. The invention defined by claim 1 wherein each of the bracket means includes a slot sized to fit over the anti-cavitation plate, and further includes a plurality of set screws and spaced threaded apertures to receive them to fasten the brackets securely to the anti-cavitation plate, the mounting brackets being compatible with anti-cavitation plates on inboard/outboard and outboard motors.

* * * * *